US009303871B2

(12) United States Patent
Woerz

(10) Patent No.: US 9,303,871 B2
(45) Date of Patent: Apr. 5, 2016

(54) COMBUSTOR ASSEMBLY INCLUDING A TRANSITION INLET CONE IN A GAS TURBINE ENGINE

(71) Applicant: Ulrich Woerz, Tega Cay, SC (US)

(72) Inventor: Ulrich Woerz, Tega Cay, SC (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 380 days.

(21) Appl. No.: 13/927,287

(22) Filed: Jun. 26, 2013

(65) Prior Publication Data

US 2015/0000287 A1 Jan. 1, 2015

(51) Int. Cl.

| | |
|---|---|
| ***F23R 3/00*** | (2006.01) |
| ***F23R 3/60*** | (2006.01) |
| ***F01D 9/02*** | (2006.01) |

(52) U.S. Cl.

CPC ..... *F23R 3/002* (2013.01); *F01D 9/023* (2013.01); *F05D 2250/232* (2013.01)

(58) Field of Classification Search

CPC ..... F23R 3/00; F23R 3/002; F23R 3/60; F23R 2900/00012; F01D 9/023

See application file for complete search history.

(56) References Cited

U.S. PATENT DOCUMENTS

| | | | | |
|---|---|---|---|---|
| 3,872,664 | A | 3/1975 | Lohmann et al. | |
| 4,184,326 | A | 1/1980 | Pane, Jr. et al. | |
| 4,187,674 | A | 2/1980 | Richardson | |
| 4,628,694 | A | 12/1986 | Kelm et al. | |
| 5,253,478 | A * | 10/1993 | Thibault, Jr. | F23R 3/14 60/733 |
| 5,701,733 | A * | 12/1997 | Lewis | F01D 9/023 415/209.2 |
| 6,068,467 | A | 5/2000 | Mandai et al. | |
| 6,427,446 | B1 | 8/2002 | Kraft et al. | |
| 6,772,594 | B2 | 8/2004 | Nishida et al. | |
| 7,895,841 | B2 | 3/2011 | Johnson et al. | |
| 2003/0213250 | A1 * | 11/2003 | Pacheco-Tougas | F23R 3/002 60/752 |
| 2004/0118122 | A1 * | 6/2004 | Mitchell | F23R 3/60 60/752 |
| 2005/0022531 | A1 * | 2/2005 | Burd | F23R 3/002 60/752 |
| 2005/0150233 | A1 * | 7/2005 | Glessner | F16B 5/0208 60/796 |
| 2006/0010879 | A1 * | 1/2006 | Aumont | F01D 9/023 60/796 |
| 2006/0242964 | A1 * | 11/2006 | Parker | F01D 9/023 60/796 |

(Continued)

FOREIGN PATENT DOCUMENTS

| | | | |
|---|---|---|---|
| DE | 19733868 | A1 | 2/1998 |
| GB | 733362 | A | 7/1955 |

*Primary Examiner* — William H Rodriguez
*Assistant Examiner* — Eric Linderman

(57) ABSTRACT

A combustor assembly defining a main combustion zone where fuel and air are burned to create hot combustion products includes a liner, a transition duct, and a transition inlet cone. The liner defines an interior volume including a first portion of the main combustion zone, and has an inlet and an outlet spaced from the inlet in an axial direction. The transition duct includes an inlet section and an outlet section that discharges gases to a turbine section. The inlet section is adjacent to the outlet of the liner and defines a second portion of the main combustion zone. The transition inlet cone is affixed to the transition duct and includes a frusto-conical portion extending axially and radially inwardly into the main combustion zone. The transition inlet cone deflects combustion products that are flowing in a radially outer portion of the main combustion zone toward a combustor assembly central axis.

15 Claims, 2 Drawing Sheets

(56) References Cited

U.S. PATENT DOCUMENTS

2007/0258808 A1* 11/2007 Ohri ..... F01D 9/023 415/139
2008/0041058 A1* 2/2008 Johnson ..... F23R 3/286 60/725
2008/0179837 A1* 7/2008 Ryan ..... F01D 9/023 277/591
2009/0260364 A1* 10/2009 Keller ..... F01D 9/023 60/753
2010/0050649 A1* 3/2010 Allen ..... F23M 5/00 60/752
2010/0064693 A1* 3/2010 Koenig ..... F01D 9/023 60/760
2010/0071376 A1* 3/2010 Wiebe ..... F23R 3/002 60/740
2011/0067402 A1* 3/2011 Wiebe ..... F23R 3/08 60/740
2011/0289928 A1* 12/2011 Fox ..... F23R 3/286 60/740
2012/0047910 A1* 3/2012 Sutcu ..... F01D 9/023 60/796
2012/0085099 A1 4/2012 Creighton et al.
2012/0291437 A1* 11/2012 Moehrle ..... F23R 3/002 60/722

* cited by examiner

COMBUSTOR ASSEMBLY INCLUDING A TRANSITION INLET CONE IN A GAS TURBINE ENGINE

FIELD OF THE INVENTION

The present invention relates to a combustor assembly in a gas turbine engine and, more particularly, to a combustor assembly including a transition inlet cone between a liner and a transition duct.

BACKGROUND OF THE INVENTION

A conventional combustible gas turbine engine includes a compressor section, a combustor section including a plurality of combustor assemblies, and a turbine section. The compressor section compresses ambient air. The combustor assemblies comprise combustor devices that mix the pressurized air with a fuel and ignite the mixture to create combustion products that define working gases. The combustion products are routed to the turbine section via a plurality of transition ducts. Within the turbine section are a series of rows of stationary vanes and rotating blades. The rotating blades are coupled to a shaft and disk assembly. As the combustion products expand through the turbine section, the combustion products cause the blades, and therefore the shaft, to rotate.

SUMMARY OF THE INVENTION

In accordance with a first aspect of the present invention, a combustor assembly defining a main combustion zone where fuel and air are burned to create hot combustion products is provided. The combustor assembly comprises a liner, a transition duct, and a transition inlet cone. The liner defines an interior volume including a first portion of the main combustion zone, and has an inlet and an outlet spaced from the inlet in an axial direction extending parallel to a central axis of the combustor assembly. The transition duct includes an inlet section and an outlet section that discharges gases to a turbine section. The inlet section is adjacent to the outlet of the liner and defines a second portion of the main combustion zone. The transition inlet cone is affixed to the transition duct and includes a frusto-conical portion extending axially and radially inwardly into the main combustion zone. The transition inlet cone deflects hot combustion products that are flowing in a radially outer portion of the main combustion zone toward the central axis of the combustor assembly.

In accordance with a second aspect of the present invention, a combustor assembly defining a main combustion zone where fuel and air are burned to create hot combustion products is provided. The combustor assembly comprises a liner, a transition duct, a fuel injection system, and a transition inlet cone. The liner defines an interior volume including a first portion of the main combustion zone, and has an inlet and an outlet spaced from the inlet in an axial direction extending parallel to a central axis of the combustor assembly. The transition duct includes an inlet section and an outlet section that discharges gases to a turbine section. The inlet section is immediately adjacent to the outlet of the liner and defining a second portion of the main combustion zone. The fuel injection system comprises at least one fuel injector that injects fuel into interior volume of the liner for being burned to create the hot combustion products. The transition inlet cone includes a generally cylindrical portion affixed to the transition duct, and a frusto-conical portion joined to the cylindrical portion and extending axially and radially inwardly into the main combustion zone at an angle of between about 30 degrees to about 60 degrees relative to the central axis such that a radially innermost edge of the transition inlet cone is located at least about 1 inch from an inner surface of the transition duct. The transition inlet cone deflects hot combustion products that are flowing in a radially outer portion of the main combustion zone toward the central axis of the combustor assembly.

In accordance with a third aspect of the present invention, a retro-fit kit is provided for a gas turbine engine combustor assembly that includes a liner and a transition duct downstream from the liner, wherein the liner and the transition duct define a main combustion zone where fuel and air are burned to create hot combustion products. The retro-fit kit comprises a transition inlet cone adapted to be installed in the combustor assembly between the liner and the transition duct for deflecting hot combustion products flowing in a radially outer portion of the main combustion zone toward a central axis of the combustor assembly during operation of the engine. The transition inlet cone comprises a generally cylindrical portion adapted to be affixed to the transition duct, and a frusto-conical portion extending axially and radially inwardly from the cylindrical portion into the main combustion zone. The transition inlet cone is adapted to deflect the hot combustion products that are flowing in the radially outer portion of the main combustion zone toward the central axis of the combustor assembly during operation of the engine.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
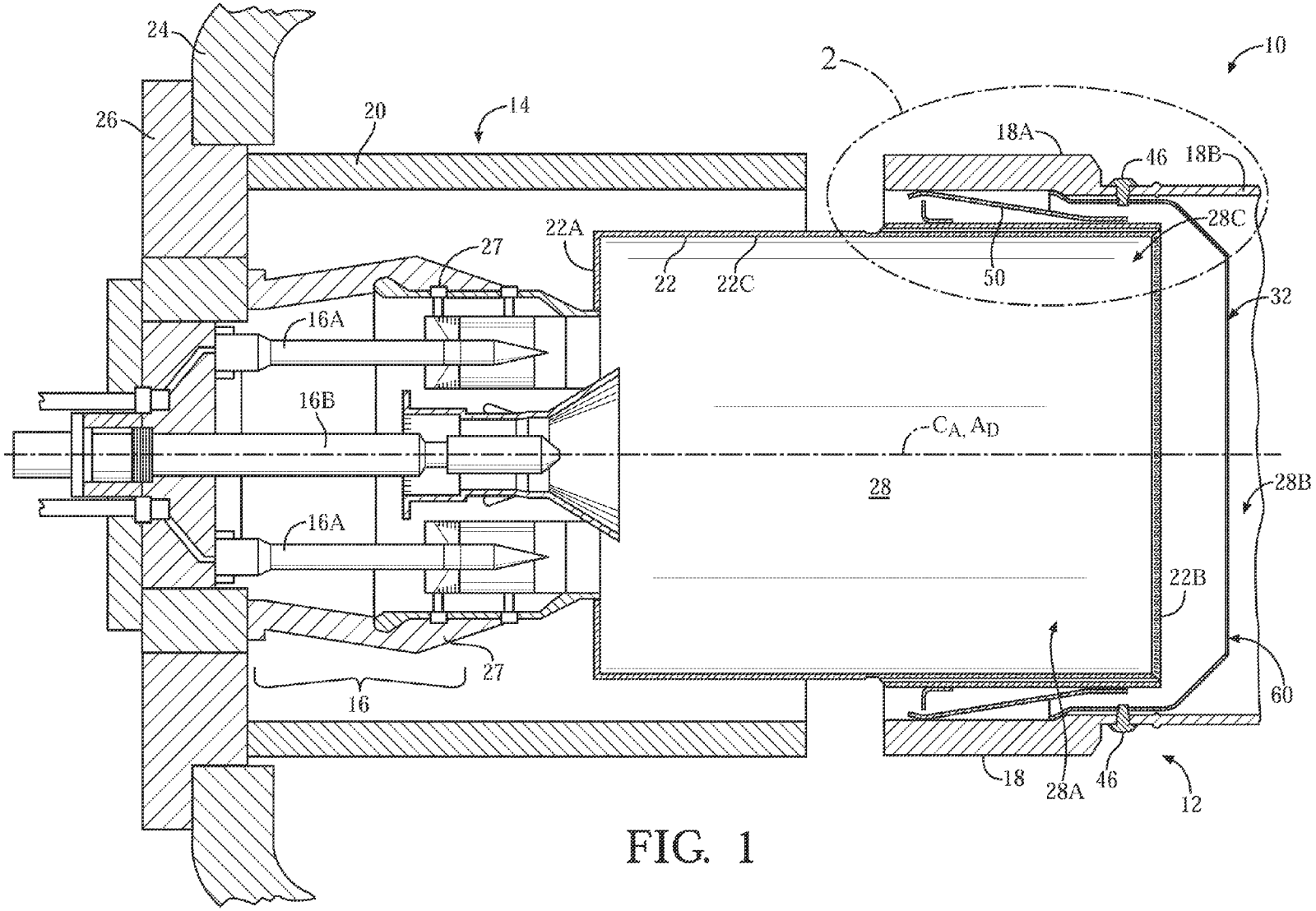
FIG. 1 is a side cross sectional view of a combustor assembly according to an embodiment of the invention.

Referring to FIG. 1, a portion of a can-annular combustion system 10 is shown. The combustion system 10 forms part of a gas turbine engine. The gas turbine engine further comprises a compressor section (not shown) and a turbine section (not shown). Air enters the compressor section, which pressurizes the air and delivers the pressurized air to the combustion system 10. In the combustion system 10, the pressurized air from the compressor section is mixed with a fuel to create an air and fuel mixture, which is ignited to create hot combustion products that define working gases. The hot combustion products are routed from the combustion system 10 to the turbine section, where they are expanded and cause blades coupled to a shaft and disk assembly to rotate in a known manner.

The can-annular combustion system 10 comprises a plurality of combustor assemblies 12. Each combustor assembly 12 comprises a combustor device 14, a fuel injection system 16, and a transition duct 18. The combustor assemblies 12 are spaced circumferentially apart from one another in the can-annular combustion system 10.

Only a single combustor assembly 12 is illustrated in FIG. 1. Each combustor assembly 12 forming a part of the can-annular combustion system 10 can be constructed in the same manner as the combustor assembly 12 illustrated in FIG. 1. Hence, only the combustor assembly 12 illustrated in FIG. 1 will be discussed in detail herein.

The combustor device 14 of the combustor assembly 12 comprises a flow sleeve 20 and a liner 22 disposed radially inwardly from the flow sleeve 20. The flow sleeve 20 is coupled to a main engine casing 24 of the gas turbine engine via a cover plate 26 and receives pressurized air therein from the compressor section as will be apparent to those having ordinary skill in the art. The flow sleeve 20 may be formed from any material capable of operation in the high temperature and high pressure environment of the combustion system 10, such as, for example, stainless steel, and in a preferred embodiment may comprise a steel alloy including chromium.

The liner 22 is coupled to the cover plate 26 via a plurality of support members 27 and defines a portion of a main combustion zone 28. That is, the liner 22 defines a first portion 28A of the main combustion zone 28 and the transition duct 18 defines a second, downstream portion 28B of the main combustion zone 28. As shown in FIG. 1, the liner 22 comprises an inlet 22A and an outlet 22B spaced from the inlet 22A in an axial direction $A_D$ extending parallel to a central axis $C_A$ of the combustor assembly 12. The liner 22 also has an inner volume 22C, which defines the first portion 28A of the main combustion zone 28. The liner 22 may be formed from a high-temperature material, such as, for example, HASTELLOY-X (HASTELLOY is a registered trademark of Haynes International, Inc.).

The fuel injection system 16 may comprise one or more main fuel injectors 16A coupled to and extending axially away from the cover plate 26 and a pilot fuel injector 16B also coupled to and extending axially away from the cover plate 26. The fuel injection system 16 depicted in FIG. 1 may also typically be referred to as a "main" or a "primary" fuel injection system, wherein one or more additional fuel injection systems (not shown) may also be provided in the combustor assembly 12. As noted above, the flow sleeve 20 receives pressurized air from the compressor section. After entering the flow sleeve 20, the pressurized air moves into the liner inner volume 22C where fuel from the main and pilot fuel injectors 16A and 16B is mixed with at least a portion of the pressurized air in the liner inner volume 22C and ignited to create the hot combustion products within the main combustion zone 28.

The transition duct 18 may comprise a conduit having a generally cylindrical inlet section 18A immediately adjacent to the outlet 22B of the liner 22, an intermediate section 18B, and a generally rectangular outlet section (not shown), which discharges the hot combustion products into the turbine section. The conduit may be formed from a high-temperature capable material, such as a nickel-based metal alloy, for example, HASTELLOY-X, INCONEL 617, or HAYNES 230 (INCONEL is a registered trademark of Special Metals Corporation, and HAYNES is a registered trademark of Haynes International, Inc.).

Figure 2:
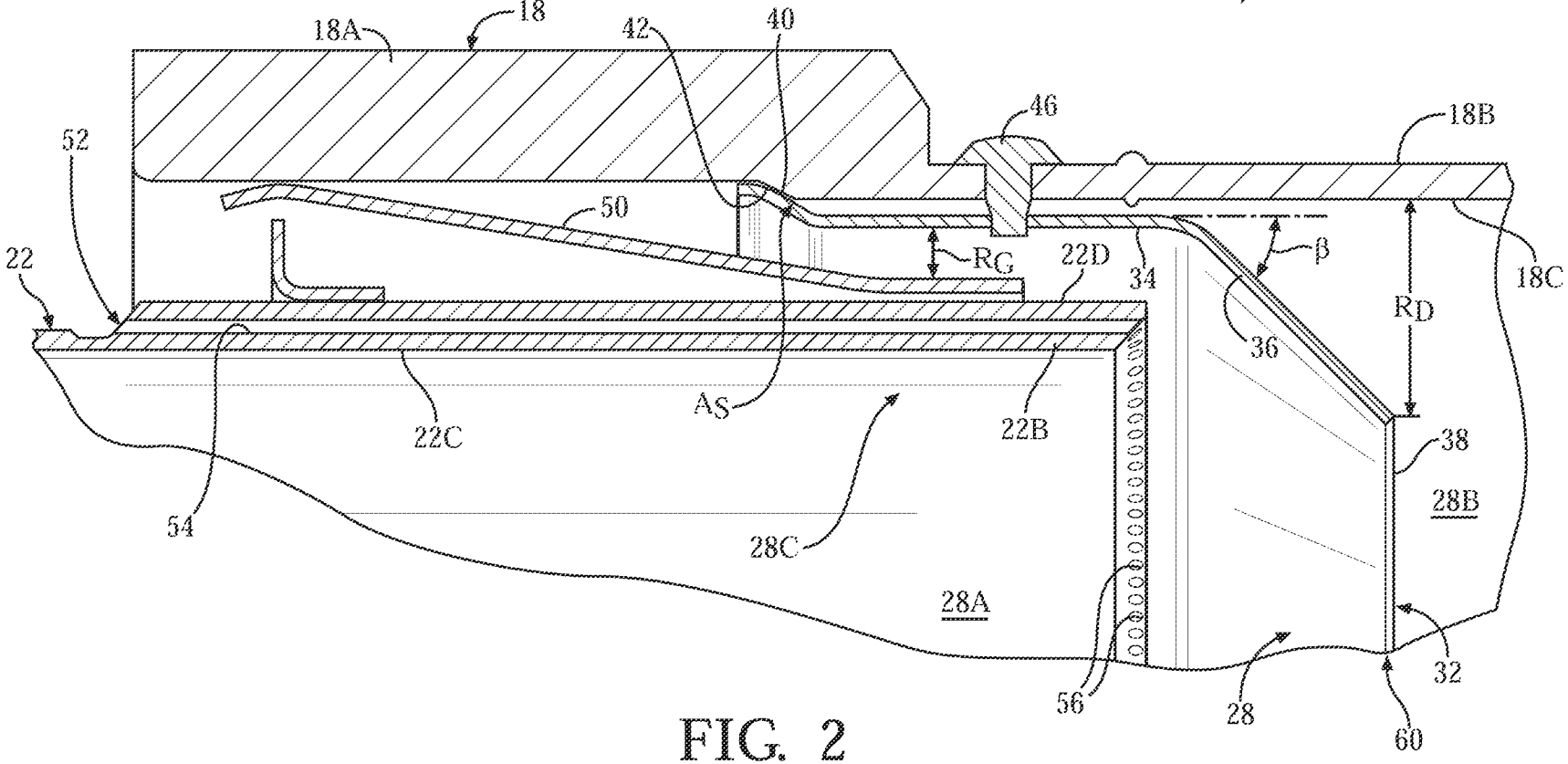
FIG. 2 is an enlarged cross sectional view illustrating a transition inlet cone located between a liner and a transition duct of the combustor assembly of FIG. 1.

Referring now to FIG. 2, the combustor assembly 12 further comprises a transition inlet cone 32 between the liner 22 and the transition duct 18. The transition inlet cone 32 is preferably formed from a different material than the transition duct 18. For example, the transition inlet cone 32 may be formed from an oxide ceramic matrix composite material, such as SiC/SiC or $Al_2O_3/Al_2O_3$.

The transition inlet cone 32 includes a generally cylindrical portion 34 that is affixed to the transition duct 18 as will be described below, and a frusto-conical portion 36 extending axially and radially inwardly from the cylindrical portion 34 into the main combustion zone 28. The frusto-conical portion 36 preferably extends from the cylindrical portion 34 into the main combustion zone 28 at an angle β of between about 30 degrees to about 60 degrees relative to the central axis $C_A$, wherein a radially innermost edge 38 of the frusto-conical portion 36 of the transition inlet cone 32 is located a radial distance $R_D$ of at least about 1 inch from an inner surface 18C of the transition duct 18.

The transition inlet cone 32 further comprises a radially outwardly extending flange 40 joined to the cylindrical portion 34 thereof. The flange 40 is received in a circumferentially extending chamfer 42 formed in the inner surface 18C of the inlet section 18A of the transition duct 18. The abutment of the flange 40 to the chamfer 42 serves as an axial stop $A_S$ for substantially preventing axial movement between the transition inlet cone 32 and the transition duct 18.

As shown in FIGS. 1 and 2, the transition inlet cone 32 is secured to the transition duct 18 via a plurality of pins 46 that extend radially from the cylindrical portion 34 of the transition inlet cone 32 to the inlet section 18A of the transition duct 18. The pins 46 substantially prevent movement, e.g., circumferential and axial movement, between the transition inlet cone 32 and the transition duct 18. The pins 46 may be formed from a high-temperature capable material, such as a nickel-based metal alloy, for example, HASTELLOY-X, INCONEL 617, or HAYNES 230, e.g., the pins 46 may be formed from the same material as the transition duct 18, such that relative thermal expansion between the pins 46 and the transition duct 18 is substantially avoided. Whether the pins 46 are formed from the same material as the transition duct 18 or not, the pins 46 are preferably formed from a material having a higher coefficient of thermal expansion than that of the transition inlet cone 32, such that the transition inlet cone 32 remains tightly in place during operation, e.g., to substantially prevent rattling movement of the transition inlet cone 32.

The combustor assembly 12 further includes a contoured spring clip structure 50 (also known as a finger seal) provided between the outlet 22B of the liner 22 and the inlet section 18A of the transition duct 18. The spring clip structure 50 in the illustrated embodiment is provided on an outer surface 22D of the liner outlet 22B (see FIG. 2) and frictionally engages the inner surface 18C of the transition duct inlet portion 18A such that a friction fit coupling is provided between the liner 22 and the transition duct 18. Alternatively, it is contemplated that the spring clip structure 50 may be coupled to the inner surface 18C of the transition duct inlet portion 18A so as to frictionally engage the outer surface 22D of the liner outlet 22B. The friction fit coupling allows movement, i.e., axial, circumferential, and/or radial movement, between the liner 22 and the transition duct 18, which movement may be caused by thermal expansion of one or both of the liner 22 and the transition duct 18 during operation of the engine. For example, relative movement caused, e.g., by differences in thermal growth between the liner 22 and the transition duct 18, may create a force that overcomes the friction force provided by the spring clip structure 50 such that substantially unconstrained movement occurs between the liner 22 and the transition duct 18.

During operation of the engine, the transition inlet cone 32 deflects hot combustion products that are flowing in a radially outer portion 28C of the main combustion zone 28 toward the central axis $C_A$ of the combustor assembly 12. While this may be advantageous under all engine operation conditions, it is believed to be particularly advantageous during less than full load, otherwise known as base load, operating conditions. That is, pollutants occurring from the combustion process in gas turbine engines are known to be nitrogen oxides (NOx) and carbon monoxide (CO). Keeping these emission types down to a minimum is an important requirement in gas turbine engines. CO tends to remain in the combustion products if there is not enough residence time available, i.e., burning time within the main combustion zone 28 for the combustion products, or if the temperature of the combustion products is too low for burn-out, which is why the CO emission type becomes a significant issue in part load operation, i.e., where temperatures of the combustion products are lower.

It has been found that the temperature of the combustion products in the radially outer portion 28C of the main combustion zone 28 may be lower than the temperature of the combustion products near the central axis CA of the combustor assembly 12. Hence, since the transition inlet cone 32 of the present invention deflects hot combustion products that are flowing in a radially outer portion 28C of the main combustion zone 28 toward the central axis $C_A$ of the combustor assembly 12, the colder temperature combustion products at the radially outer portion 28C of the main combustion zone 28 are forced toward the central axis $C_A$ of the combustor assembly 12 where they are brought to a higher temperature, thus reducing CO emissions.

Further, as shown in FIG. 2, a radial gap $R_G$ is formed between the spring clip structure 50 and the transition inlet cone 32. A portion of the compressed air from the compressor section located outside of the combustor assembly 12 that leaks through the spring clip structure 50 is able to pass through the radial gap $R_G$ and into the main combustion zone 28 to further assist in pushing hot combustion products away from the radially outer portion 28C of the main combustion zone 28 toward the central axis $C_A$ of the combustor assembly 12, and thus further reducing CO emissions.

Additionally, as shown in FIG. 2, the liner 22 includes a convention cooling system 52. The cooling system 52 comprises a plurality of axially ending passages 54 that extend through the liner 22 to the liner outlet 22B, wherein cooling air, i.e., compressed air from the compressor section located outside of the combustor assembly 12, passing through the passages 54 exits the liner 22 through a plurality of circumferentially spaced apart passage outlets 56. The cooling air exiting the liner 22 through the passage outlets 56 flows toward the frusto-conical portion 36 of the transition inlet cone 32 and further assists in pushing hot combustion products away from the radially outer portion 28C of the main combustion zone 28 toward the central axis $C_A$ of the combustor assembly 12, and thus further reducing CO emissions.

Moreover, forming the transition inlet cone 32 from an oxide ceramic matrix composite material has the following advantages. Oxide ceramic matrix composite materials have very good material properties up to temperatures of around 1200° C., wherein the radially innermost edge 38 of the transition inlet cone 32 may be exposed to temperatures of up to about 1100° C. during operation. For example, while many types of ceramic materials break rather easily, oxide ceramic matrix composite materials have strong mechanical properties, e.g., similar to the bending strength of steel, since they utilize an elastic core made from structural ceramic fibers such as NEXTEL 610 (NEXTEL is a trademark of 3M Company). If a metal or nickel base material was used for the transition inlet cone 32, additional cooling would likely be required on the backside in order to maintain lifetime expectations of the part. However, by using an oxide ceramic matrix composite material, no additional cooling is required, which has two advantages. That is, it avoids the use of additional cooling air, which would be required for a transition inlet cone made from a Nickel Base Alloy such as INCONEL or HASTELLOY-X. This prevents an increase of NOx emissions, as this cooling air is still available for the combustion process. And it does not have a negative impact on the efficiency of the gas turbine engine, i.e., the use of cooling air lowers the temperature of the combustion products, which lowers the efficiency of the engine.

Finally, it is noted that the radial stacking of the components shown in FIG. 2 is as follows: the liner outlet 22B is the radially innermost component, with the spring clip structure 50 being positioned radially outwardly from the liner outlet 22B; the cylindrical portion 34 of the transition inlet cone 32 is positioned radially outwardly from the spring clip structure 50; and the inlet section 18A of the transition duct 18 is positioned over the cylindrical portion 34 of the transition inlet cone 32. This arrangement is particularly advantageous, as the transition inlet cone 32 is able to be installed into an existing combustor assembly 12, i.e., one that did not previously include a transition inlet cone 32, with little or no modification of the components of the existing combustor assembly 12. Since typical transition ducts 18 may already include the circumferentially extending chamfer 42, i.e., chamfers 42 are typically created by a counter bore that is machined after forming the transition duct 18 to effect a cylindrical inner diameter in the transition duct 18 that the liner 22 is capable of being fitted into such that the spring clip structure 50 may provide a sealing function as intended, the flange 40 of the transition inlet cone 32 can efficiently be positioned correctly in the existing combustor assembly 12. Along these lines, the transition inlet cone 32 described herein can be implemented as part of a retro-fit kit 60 to be installed into an existing combustor assembly 12.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combustor assembly defining a main combustion zone where fuel and air are burned to create hot combustion products, the combustor assembly comprising:

a liner defining an interior volume including a first portion of the main combustion zone, the liner having an inlet and an outlet spaced from the inlet in an axial direction extending parallel to a central axis of the combustor assembly;

a transition duct having an inlet section and an outlet section that discharges gases to a turbine section, the inlet section being adjacent to the outlet of the liner and defining a second portion of the main combustion zone;

a transition inlet cone affixed to the transition duct and including a frusto-conical portion extending axially and radially inwardly into the main combustion zone, wherein the transition inlet cone deflects hot combustion products that are flowing in a radially outer portion of the main combustion zone toward the central axis of the combustor assembly;

a spring clip structure positioned radially between the outlet of the liner and a portion of the transition inlet cone thereby forming a radial gap; and wherein the transition inlet cone further comprises a radially outwardly extending flange joined to the cylindrical portion, and wherein the flange is received in a chamfer formed in the inlet section of the transition duct to serve as an axial stop for substantially preventing axial movement between the transition inlet cone and the transition duct.

2. A combustor assembly as set out in claim 1, wherein the transition inlet cone further comprises a cylindrical portion joined to the frusto-conical portion, and wherein the transition inlet cone is affixed to the transition duct at the cylindrical portion.

3. A combustor assembly as set out in claim 2, wherein the transition inlet cone is secured to the transition duct via a plurality of pins that extend radially from the cylindrical portion of the transition inlet cone to the inlet section of the transition duct.

4. A combustor assembly as set out in claim 3, wherein the transition inlet cone is formed from a different material than the transition duct.

5. A combustor assembly as set out in claim 4, wherein the transition inlet cone is formed from an oxide ceramic matrix composite material and the transition duct is formed from a nickel-based metal alloy.

6. A combustor assembly as set out in claim 5, wherein the pins are formed from a nickel-based metal alloy.

7. A combustor assembly as set out in claim 1, wherein:

air from outside of the combustor assembly that leaks through the spring clip structure is able to pass through the radial gap and into the main combustion zone to push hot combustion products away from the radially outer portion of the main combustion zone toward the central axis of the combustor assembly.

8. A combustor assembly as set out in claim 1, wherein the frusto-conical portion of the transition inlet cone extends into the main combustion zone at an angle of between about 30 degrees to about 60 degrees relative to the central axis.

9. A combustor assembly as set out in claim 8, wherein the frusto-conical portion of the transition inlet cone extends into the main combustion zone such that a radially innermost edge of the transition inlet cone is located at least about 1 inch from an inner surface of the transition duct.

10. A combustor assembly defining a main combustion zone where fuel and air are burned to create hot combustion products, the combustor assembly comprising:

a liner defining an interior volume including a first portion of the main combustion zone, the liner having an inlet and an outlet spaced from the inlet in an axial direction extending parallel to a central axis of the combustor assembly;

a transition duct having an inlet section and an outlet section that discharges gases to a turbine section, the inlet section being immediately adjacent to the outlet of the liner and defining a second portion of the main combustion zone;

a fuel injection system comprising at least one fuel injector that injects fuel into interior volume of the liner for being burned to create the hot combustion products; and a transition inlet cone including:

a cylindrical portion affixed to the transition duct;

a frusto-conical portion joined to the cylindrical portion and extending axially and radially inwardly into the main combustion zone at an angle of between about 30 degrees to about 60 degrees relative to the central axis such that a radially innermost edge of the transition inlet cone is located at least about 1 inch from an inner surface of the transition duct, wherein the transition inlet cone deflects hot combustion products that are flowing in a radially outer portion of the main combustion zone toward the central axis of the combustor assembly; and wherein the transition inlet cone further comprises a radially outwardly extending flange joined to the cylindrical portion, and wherein the flange is received in a chamfer formed in the inlet section of the transition duct to serve as an axial stop for substantially preventing axial movement between the transition inlet cone and the transition duct.

11. A combustor assembly as set out in claim 10, wherein the transition inlet cone is secured to the transition duct via a plurality of pins that extend radially from the cylindrical portion of the transition inlet cone to the inlet section of the transition duct.

12. A combustor assembly as set out in claim 10, further comprising a spring clip structure provided between the outlet of the liner and the inlet section of the transition duct to provide a friction fit coupling between the liner and the transition duct, wherein the spring clip structure is positioned radially between the outlet of the liner and a portion of the transition inlet cone, wherein:

a radial gap is formed between the spring clip structure and the portion of the transition inlet cone; and air from outside of the combustor assembly that leaks through the spring clip structure is able to pass through the radial gap and into the main combustion zone to push hot combustion products away from the radially outer portion of the main combustion zone toward the central axis of the combustor assembly.

13. A retro-fit kit for a gas turbine engine combustor assembly that includes a liner and a transition duct downstream from the liner, wherein the liner and the transition duct define a main combustion zone where fuel and air are burned to create hot combustion products, the retro-fit kit comprising:

a transition inlet cone adapted to be installed in the combustor assembly between the liner and the transition duct for deflecting hot combustion products flowing in a radially outer portion of the main combustion zone toward a central axis of the combustor assembly during operation of the engine, the transition inlet cone comprising:

a cylindrical portion adapted to be affixed to the transition duct;

a frusto-conical portion extending axially and radially inwardly from the cylindrical portion into the main combustion zone, wherein the transition inlet cone is adapted to deflect the hot combustion products that are flowing in the radially outer portion of the main combustion zone toward the central axis of the combustor assembly during operation of the engine; and wherein the transition inlet cone further comprises a radially outwardly extending flange joined to the cylindrical portion, and wherein the flange is adapted to be received in a chamfer formed in the inlet section of the transition duct to serve as an axial stop for substantially preventing axial movement between the transition inlet cone and the transition duct.

14. A retro-fit kit as set out in claim 13, wherein the transition inlet cone is adapted to be secured to the transition duct via a plurality of pins that extend radially from the cylindrical portion of the transition inlet cone to the inlet section of the transition duct.

15. A retro-fit kit as set out in claim 13, wherein:

the transition inlet cone is adapted to be installed in the combustor assembly such that a radial gap is formed between the cylindrical portion of the transition inlet cone and a spring clip structure that is provided between an outlet of the liner and an inlet section of the transition duct to provide a friction fit coupling between the liner and the transition duct; and air from outside of the combustor assembly that leaks through the spring clip structure during operation of the engine is able to pass through the radial gap and into the main combustion zone to push hot combustion products away from the radially outer portion of the main combustion zone toward the central axis of the combustor assembly.

* * * * *